US005579618A

United States Patent [19]

Riegelman

[11] Patent Number: 5,579,618

[45] **Date of Patent: *Dec. 3, 1996**

[54] COMPOSITE FRAMING MEMBER CONSTRUCTION FOR WINDOWS AND DOORS

[76] Inventor: Harry M. Riegelman, 2417 Wimbledon Dr., Arlington, Tex. 76017

[ * ] Notice: The term of this patent shall not extend beyond the expiration date of Pat. No. 5,491,951.

[21] Appl. No.: 469,333

[22] Filed: Jun. 6, 1995

Related U.S. Application Data

[63] Continuation of Ser. No. 203,712, Feb. 28, 1994, which is a continuation of Ser. No. 788,632, Nov. 6, 1991, abandoned.

[51] Int. Cl.[6] ..... G04C 1/00

[52] U.S. Cl. ..... 52/309.16; 52/656.1; 52/656.2; 52/730.1

[58] Field of Search ..... 52/309.16, 727, 52/656.1, 309.7, 204, 731, 716.1; 49/441, 491

[56] References Cited

U.S. PATENT DOCUMENTS

| | | | |
|---|---|---|---|
| 2,581,532 | 1/1952 | Hem | 280/11.13 |
| 3,470,598 | 10/1969 | Berthelsen | 51/309.16 |
| 3,703,063 | 11/1972 | Budich et al. | 52/727 |
| 3,760,544 | 9/1973 | Hawes et al. | 52/468 |
| 3,767,504 | 10/1973 | Singleton | 156/268 |
| 3,964,231 | 6/1976 | Budich et al. | 52/727 |
| 4,130,976 | 12/1978 | Kesseler et al. | 52/656 |
| 4,234,638 | 11/1980 | Yamazue et al. | 428/133 |
| 4,271,634 | 6/1981 | Ardrezejewski | 49/491 |
| 4,341,831 | 7/1982 | Kleiss | 428/188 |
| 4,492,063 | 1/1985 | Schock et al. | 52/309.7 |
| 4,569,154 | 2/1986 | Bayer | 49/504 |
| 4,640,054 | 2/1987 | Breimeier et al. | 49/504 |
| 4,689,933 | 9/1987 | Biro | 52/656 |
| 4,715,153 | 12/1987 | Rohrman | 52/213 |
| 4,776,556 | 10/1988 | Dingler | 249/53 R |
| 4,974,366 | 12/1990 | Tizzoni | 49/504 |
| 4,977,722 | 12/1990 | Taylor | 52/731 |

OTHER PUBLICATIONS

The Design Engineer's Guide to Polymer/Metal Composites, Nov. 1986 by Kingston–Warren Co. Newfields, NH 03856.

*Primary Examiner*—Carl D. Friedman
*Assistant Examiner*—Beth A. Aubrey
*Attorney, Agent, or Firm*—Robert A. Seemann

[57] ABSTRACT

A unitary composite frame member of two or more structural elements. A first and a second of the elements each contributes strength to the member. The second element, a plastic, encloses the first element on essentially all surfaces along the length of the first element, and is molded to itself through openings in the first element. The first element is discontinuous in that it is two walls attached lengthwise, and a third wall parallel to them and separate from them. In one embodiment, the third wall and one of the two walls intersect laterally.

13 Claims, 17 Drawing Sheets

COMPOSITE FRAMING MEMBER CONSTRUCTION FOR WINDOWS AND DOORS

This application is a continuation of application Ser. No. 08/203,712 filed Feb. 28, 1994, which is a continuation of Ser. No. 07/788,632 filed Nov. 6, 1991, now abandoned.

BACKGROUND OF THE INVENTION

1. Field of the Invention

The present invention relates in general to composite framing for building closures, more specifically to framing construction of low thermal transmittance, high strength, and low cost.

2. Description of the Prior Art

Most present day framing members for windows and doors are fabricated from finite lengths of a single material, mainly extruded aluminum, extruded plastic, or wood millwork.

Extruded aluminum offers stiffness and strength, low cost and low maintenance, but has high thermal conductivity. Extruded plastic offers low thermal conductivity, low maintenance and moderate cost, but does not have the stiffness and strength of aluminum. Wood millwork offers low thermal conductivity and reasonable structural qualities, but is higher in cost and requires considerable maintenance.

Preferably a framing member should be a composite of two or more materials, for example, metal and plastic, integrating the best characteristics from each material.

Framing construction art is replete with composite element designs incorporating metals and plastics.

Budich et al. in U.S. Pat. No. 3,703,063, patented Nov. 21, 1972, describes a profile element for windows or doors, comprising a hollow closed metal section surrounded by a shell of plastic for resistance to corrosion and for heat insulation.

He teaches that art prior to his invention includes a great variety of designs having a common disadvantage. It is that the number of basic profiles required for window and door facade assembly is relatively large and that numerous auxiliary profiles are necessary for combining these basic profiles into a flawless, tight connection to the structural component.

The Budich profile overcomes this by providing a plurality of projections of the plastic shell with each projection being for a different application such as a saw-tooth projection for contact with glazing, anchoring means for securing the metal portion to a fixed structure in the form of connecting projections of first and second legs extending in parallel relationship with transverse end portions directed toward each other, and an abutment projection of special shape, for attachment to another Budich profile, so that the profile member has a generally more universally adaptable configuration.

Depending upon their shapes, the projections may be manufactured integrally with the plastic shell, or independently thereof, in which the latter case they are joined to the shell subsequently, for example, by cementing or welding.

U.S. Pat. No. 4,271,634 patented Jun. 9, 1981 by H. Andrzejewski, discloses a metal carrier for channel-shaped sealing, trimming or finishing strip for a channel-shaped window glass guide such as used in automobile window or door openings which resists and limits stretching. It comprises a series of U-shaped metal elements arranged in side-by-side and spaced apart relationship so as to define a channel.

The elements are connected to one another alternately in series by only a link between the apex of the U, or by a pair of links between the legs, one link being on each side of the U.

Each of the legs connected by a link, further includes an extension adjacent to its distal end. The extension terminates in an abutment face that is adjacent to the abutment face of the corresponding connected leg.

The carrier is covered by flexible plastic in which are imbedded the elements, legs, links and abutments. Manufacture is suggested to be by cutting slots in a metal blank by stamping or pressing, then rolling the blank longitudinally in to a U-shape, and after manufacturing the blank, feed the blank into a cross-head extruder so as to cover it with the extruded plastic or rubber.

A tubular seal on one side of the U, along the length of the carrier may be included integrally with the covering, or may be secured to it by some means. In either case it need not be of the same hardness as the carrier covering.

The alternate links permit the carrier to flex during installation, while the abutting extensions prevent or limit stretching of the strip so that it will resile quickly at the time of installation of the strip to a body, for a better and more secure fit.

U.S. Pat. No. 4,569,154 patented by M. Bayer on Feb. 11, 1986, discloses a metal and plastic composite type construction for window framing which, instead of plastic coating over metal, consists of an inside facing plastic extrusion member joined by interconnecting interlocking barbs, darts or arrows to a generally parallel outside facing metal extrusion member. One member is more rigid than the one to which it is joined, and one member has lower thermal conductivity than the one to which it is joined. The shape of the barbs is important to a success of providing a positive lock function for securing the parts together to provide thermal insulation coupled with window strength.

U.S. Pat. No. 4,640,054, patented Feb. 3, 1987 by Breimeier et al., describes a frame for windows or doors which consists of two plastic covered, hollow metal sections, joined by the plastic of their coverings. One section is exposed to the outside environment, the other to the inside environment.

This is different from the art in which a single, plastic covered hollow metal section is exposed to the inside environment on one side, and the outside environment on the other side.

In Breimer's invention, the plastic that is covering and joining the two sections provides thermal insulation. The arrangement permits the two thermally separated hollow aluminum sections to assume different temperatures whereby their elongations and shrinkages have less affect on the neighboring plastic than other designs in the art.

U.S. Pat. No. 4,715,153, patented Dec. 29, 1987 by H. Rohrman, discloses a universal building panel structural frame member which may be used as a head member, side jamb member, sill member, vertical mullion, and horizontal transom member, to form those structures without a need for members of different design, and brackets, plates and bolts to join them.

The invention comprises a unitary elongate roll-formed element that can be cut to length to provide structural members for the above purposes. The element is J-shaped in cross-section, having a flat elongate intermediate plate member, a head on one side of the plate member having portions laterally extending outwardly in opposite directions from the plate member, and a foot member on the opposite side of the plate member laterally extending therefrom. A pair of opposed elongate lips also extend from the plate member.

A preferred embodiment comprises a steel J-shaped member coated with an elastomeric or other thermally insulating coating. The steel adds structural strength without adding bulk. The coating provides thermal insulation without reducing the structural strength of the curtain wall members.

U.S. Pat. No. 4,974,366, patented Dec. 4, 1990 by S. Tizzoni, describes a frame construction for a door opening. The frame includes a reinforced, insulated jamb member which comprises an elongated metal U-shaped channel with one leg being toward the inside environment, and the other leg being toward the outside environment.

The elongated open front end of the channel is closed by a vinyl cover thereby defining with the channel an elongated cavity. An insulating foam is injected into the cavity. After the foam hardens into a rigid and strong insulating core, the back of the U-shaped channel is sawed through lengthwise to establish a metal free insulating space between the legs of the channel.

The rigidity of the jamb is assured by the hardened insulating material between the legs. Retention of the insulating material by the legs is aided by surface grip characteristic of the Isolok TM polyurethane based rigid foam and by flanges along the length of the legs which project into the cavity.

The insulating foam is dense enough to hold hinge screws driven through the vinyl cover and into the foam, and rigid enough to withstand flexion forces exerted by weight of a door on the screws.

SUMMARY OF THE INVENTION

It is one object of the invention to provide a unitary composite frame member, of two or more materials, which has high structural strength, low thermal transmittance and low cost.

It is another object of the invention to provide an inexpensive unitary composite framing member of high structural strength and low thermal transmittance, which can be constructed by forming a first material, and covering it by a second material.

It is another object of the invention to provide the above unitary composite member in which the first material is of high strength, and the second material is of moderate strength but significantly lower thermal conductivity than the first material.

It is still another object to provide the above unitary composite member in which the second material is mechanically bonded to the first material to obtain maximum combined strength and to resist forces of differential thermal expansion.

It is still another object to provide the above unitary composite member in which the first material has portions removed in such a manner as to substantially restrict thermal flow through the material but not significantly reduce its structural strength.

In accordance with the invention a frame member of predetermined shape includes a first element that is structural in nature for contributing structural strength to the member. It is substantially non-hollow in transverse cross section.

A second inflexible element of the frame member comprises the shape of the frame member. It encloses the first element along its length in a composite, unitary molding.

If desired, the second element may cover the first element, to the extent that the shape of the frame member is expressed by the second element.

The first element may be made from a material which has high thermal conductivity.

Preferably, the first element is made with metal, and the second element is made with plastic, each of the elements being strong enough to retain its shape without aid from the other element.

The type of plastic and thickness of the second element is chosen for the second element to contribute to the strength of the member, and to be of significantly lower thermal conductivity than the first element.

Preferably, the second element contributes at least 10% of the total structural strength of the entire member and has a thermal conductivity not exceeding 5%, and preferably not exceeding 1% of that of the first element.

The two elements are molded together with a mechanical grip that maximizes the combined strength of the two elements and resists differential expansion, by molding the second element in a plurality of similarly shaped openings in the first element thereby restricting slippage and detrimental effects from difference in thermal expansion between the two elements. The shapes of the openings include rectangular, angular, circular and mesh.

A method for making the composite frame member of predetermined shape includes forming a metal strip into a U-channel, passing the U-channel through a plastic extruder for coating the steel strip with plastic in a thickness that increases the strength of the member, and sawing through the coating and U-channel between the legs of the U-channel, for substantially reducing thermal transmittance of the frame.

BRIEF DESCRIPTION OF THE DRAWINGS

In order that the invention be more fully comprehended, it will now be described, by way of example, with reference to the accompanying drawings, in which:

FIG. 1 is an all aluminum frame according to prior art.

FIG. 2 thermally broken "TB aluminum", aluminum frame according to prior art.

FIG. 3 is an all vinyl frame according to prior art.

FIG. 4 is an all wood frame according to prior art.

FIGS. 5–11 are composite constructions according to the present invention. These examples are made from vinyl and steel in various configurations for comparison of their relative strength, cost and thermal transmittance values.

FIG. 12 is a perspective view of a high bond, high strength composite frame of low thermal transmittance and cost.

FIG. 13 is a perspective view of another high bond composite frame of low thermal transmittance and cost.

FIG. 14 is a perspective view of a high bond, high strength, composite frame of low thermal transmittance and cost.

FIG. 15 perspective view of a high bond, high strength frame of low thermal transmittance and cost.

FIG. 16 is a perspective view of a high bond, high strength frame of low thermal transmittance and cost.

FIG. 17 is a perspective view of manufacturing stages of a high bond, high strength frame of low thermal transmittance and cost.

FIG. 18 is a perspective view of a box-beam composite construction.

FIG. 19 is a perspective view of an H-beam composite construction.

FIGS. 20 and 21 are sliding glass door assemblies incorporating the variations of the frames shown in FIGS. 5–19.

DESCRIPTION OF THE PREFERRED EMBODIMENTS

Figure 1:
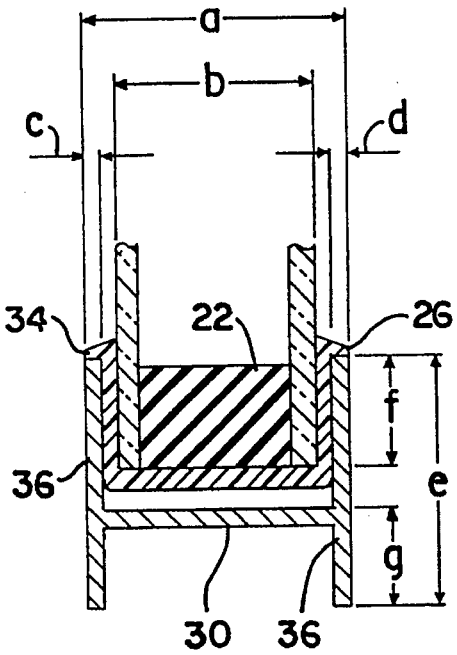
FIG. 1 PRIOR ART
FIGS. 1–11 are cross section diagrammatic views of window frames for comparison of strength, cost and thermal transmittance.
Figure 2:
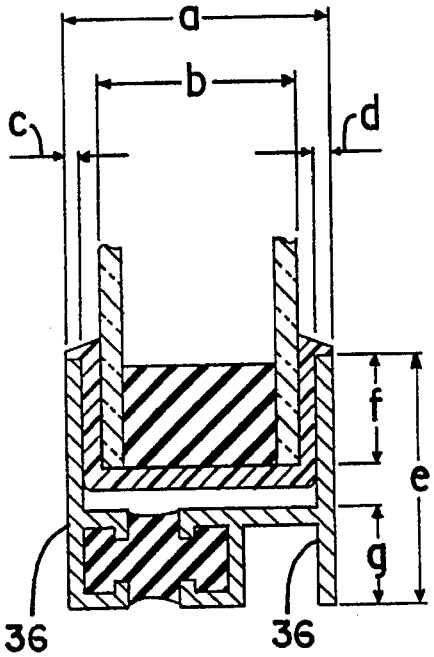
FIG. 2 PRIOR ART

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation. For convenience of the reader in understanding the invention, copending application Ser. No. 08/203,712, now U.S. Pat. No. is incorporated herein by reference.

A frame constructed according to the present invention includes at least two structurally strong materials, one having substantially lower thermal conductivity properties.

Relative strength, cost and thermal transmittance values for FIGS. 1–11 are provided in chart A. These figures typify constructions for windows and sliding glass doors. Shown in cross section, they include, for comparison, an all aluminum frame, FIG. 1, a thermally broken "TB" aluminum frame, FIG. 2, an all plastic frame with hollow legs and base, FIG. 3, and a solid wood frame, FIG. 4.

In the figures, window pane 22 held by locating strip 26 rests in channel 30, supported by shoulders 34 on forward channel legs 36.

Figure 5:
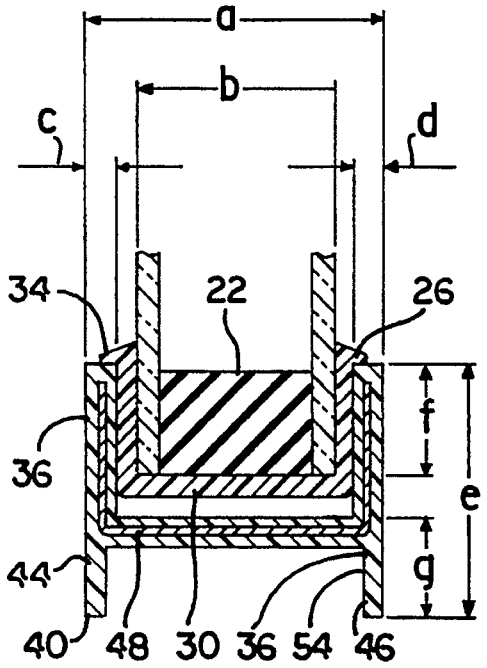

Referring to FIG. 5, frame 40 which is constructed according to the invention includes structurally strong plastic 46 which covers structural steel U-channel element 48 to a thickness that insulates and adds strength to the frame. This is different from the common relatively soft or thin plastic coatings or laminations provided for insulation and corrosion resistance.

Preferably the plastic is rigid and capable of retaining its shape as recognizable at rest without aid from the metal.

Rearward depending legs 54 are made of the same structurally strong plastic. They resist twisting and bending forces on the frame without substantially adding weight or thermally receptive surface area.

Preferably, the relationship of plastic to metal in a unitary construction according to the invention is such that the plastic provides at least 10% of the structural strength of the entire item and the thermal conductivity of the plastic does not exceed 1% of that of the metal.

For example, in a strength test in which a portion that would contain metal is bent without the metal contained, the portion will provide at least 10% of the strength that the portion would provide as the composite portion of the unitary construction.

Preferably the ratio of the composite elements in type and arrangement is selected so that thermal transmittance of the total composite shape does not exceed 70% of the conductivity of the metal element.

Figure 6:
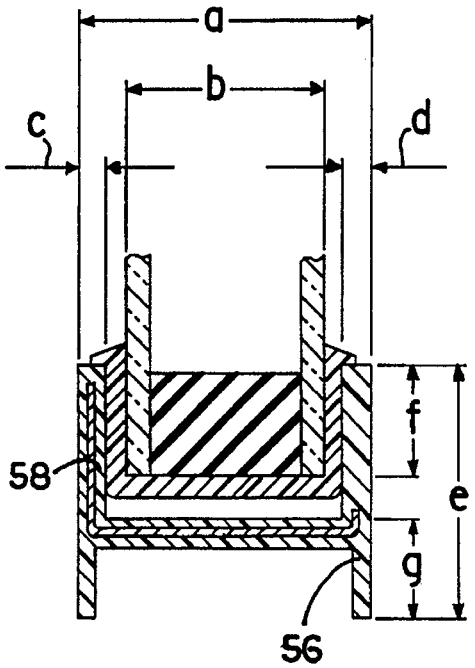

FIG. 6 shows a frame 56 which is similar to FIG. 5 except that one leg of the steel U-channel element 58 is shorter than the other.

Figure 7:
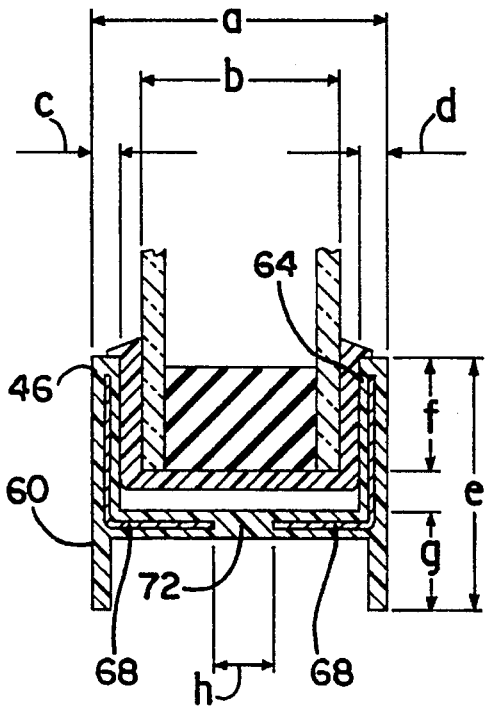

In FIG. 7, frame 60 includes U-channel 64 comprising parallel L-shaped structural steel strips 68 and structural plastic 46.

Gap 72 lowers the thermal transmittance of the frame. Complete encapsulation of strips 68 in structural plastic further contributes to lowering the thermal transmittance and adds strength to the frame.

Frame 60 is preferably made by continuous extrusion of the plastic structural element over the strips.

Sources for making frame 60 to specifications in accordance with the present invention by adjustment of the source's processes are available. For example, Kingston-Warren Company, Composite Technology Division 11/1986 bulletin THE DESIGN ENGINEER'S GUIDE TO POLYMER/METAL COMPOSITES offers a service of manufacturing elements constructed of plastic over metal by non-adhesive bonding.

In the process, as it is described, progressive roller dies shape a continuous metal strip. The polymer (rubber, synthetic, or blend) is extruded onto the passing metal. It is bonded and cured in the same production line, which might also include operations such as cutting, notching, punching, or coating. The product leaves the line in net or near-net shape. Two or more polymer sections may be permanently joined by cross heading and multiple extrusion lines.

Figure 8:
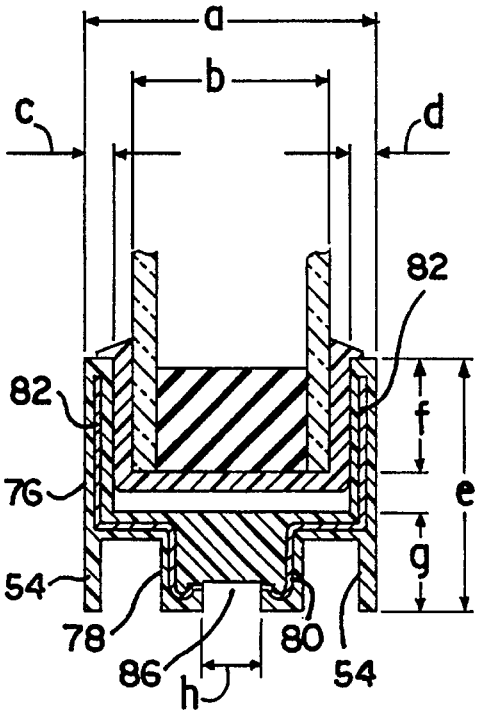

Frame 76, FIG. 8, is stronger than frame 60 and has a lower thermal transmittance.

Rearwardly depending leg 78 of structural plastic, which is wider than rearwardly depending legs 54, and second stage, rearwardly displaced J-shaped portions 80 of first stage steel L-strips 82 increase overall resistance to twist and bend of the frame.

Gap 86 is preferably made by continuous saw cut as or after composite frame 76 leaves the extrusion die.

Figure 9:
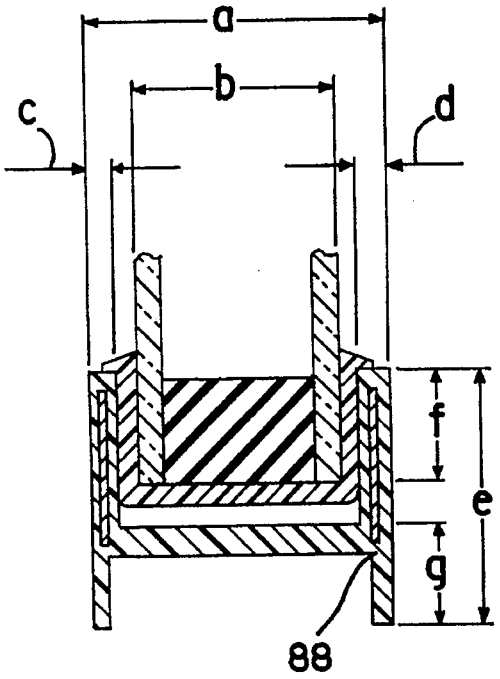

Referring to FIG. 9, frame 88 features a wider gap between metal strips. This provides a lower thermal transmittance for the frame which obtains its strength and stiffness from the plastic, and resistance to bending from the metal.

Figure 10:
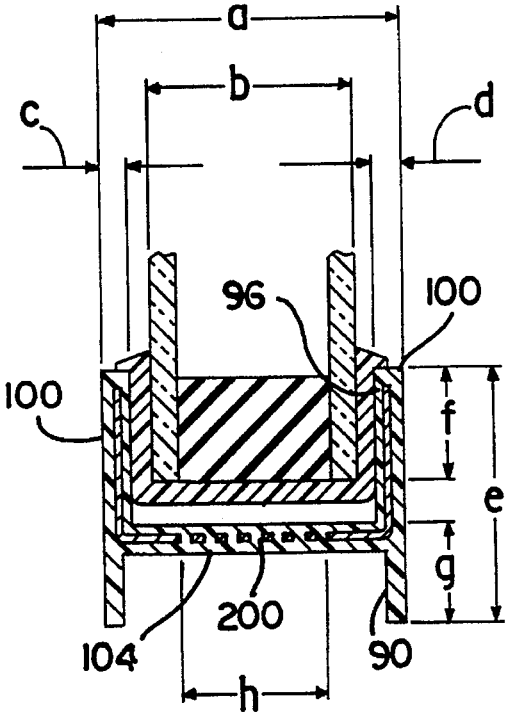

Referring to FIG. 10, frame 90 has greater resistance to twist and bend forces than does frame 60 shown in FIG. 7. This is because steel U-channel element 96 has continuity across strip 104 between forward channel legs 100. Although 80% of the metal is removed in strip 104 to reduce thermal flow between its legs, the remaining 20% is in the form of grid 200 for strength and rigidity. Grid 200 may be seen in FIG. 12.

Full benefit of the combined strength of structural plastic 46 and metal 96 is obtained by assuring the mechanical bond relationship between the plastic and the metal. Differences in thermal expansion and bending can apply disruptive forces to the bond. This is overcome by passage of the plastic through openings 204 in grid 200 so that it conforms to the cavities therein. Preferably extrusion parameters are set to assure that plastic passing though openings 204 from one side of U-channel element 96 fuses with plastic that it meets from the other side of 96.

Figure 11:
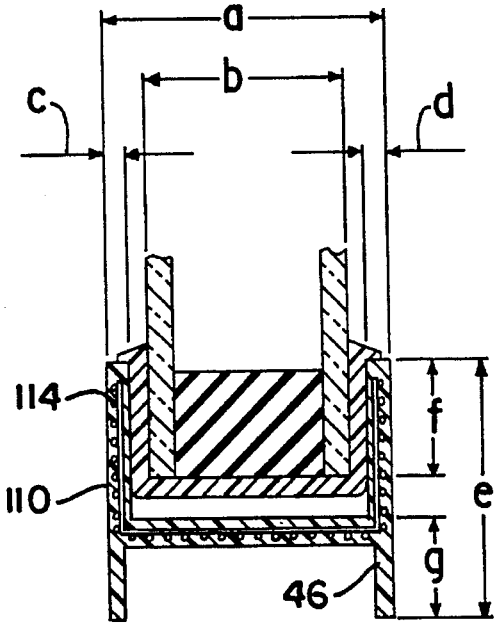

In frame 110, FIG. 11, bond between structural plastic 46 and steel U-channel element 114 in which the plastic passes through the metal element incorporates all of element 114 which is a mesh. In this arrangement the rigidity of frame 110 can be closely controlled to a predetermined specification while reasonable strength and resistance to bending is maintained, with low thermal transmittance and cost.

Figure 13:
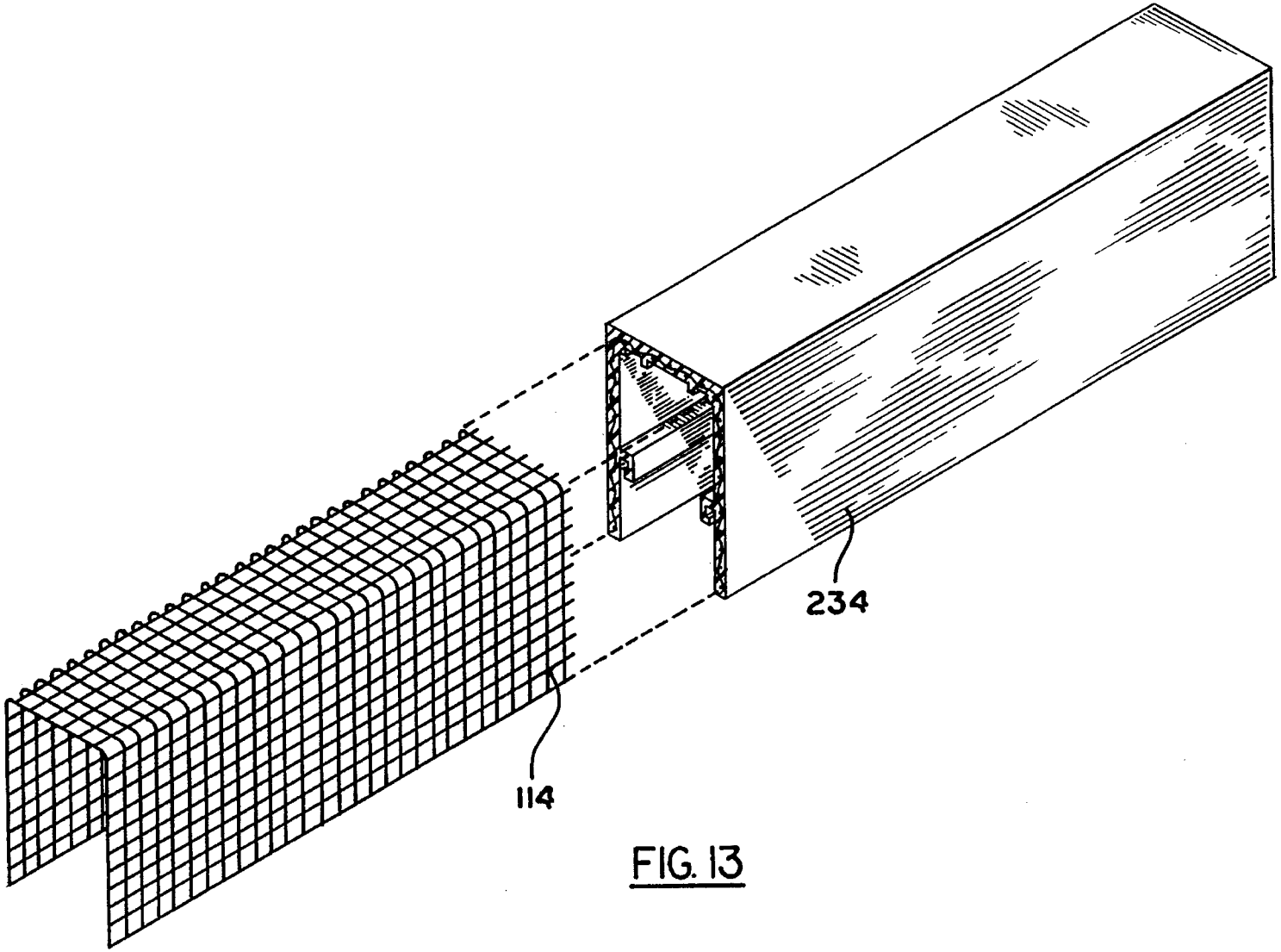

Preferably rigidity and strength is mostly controlled by the plastic, while resistance to bending is controlled by the mesh having a discrete structural shape as may be seen in FIG. 13. This is different from Fiberglas layered buildup construction.

For a lower U value, the mesh is made from stretch-resistant plastic rod, or natural or synthetic fiber.

As with the formed metal elements shown in FIGS. 5–10, the mesh element may be molded with the plastic into a continuous frame component by a plastic extrusion process.

Relative strength, cost and thermal transmittance values for the above designs may be compared in the following chart "A" where, in like dimensional indicators a–g, the magnitude of the reference dimensions are selected for purpose of example, and are not to be construed as limitations upon actual construction.

Figure 3:
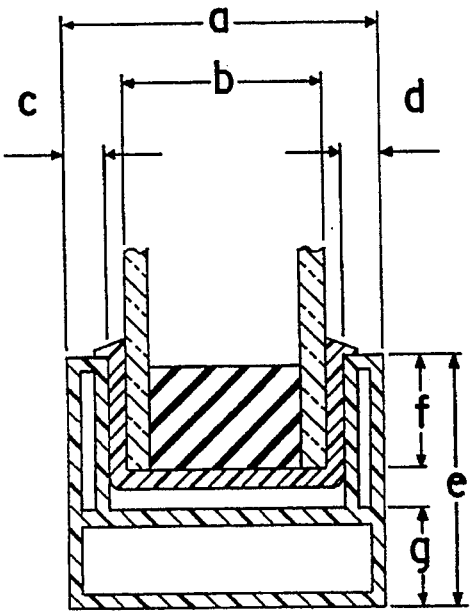
FIG. 3 PRIOR ART
Figure 4:
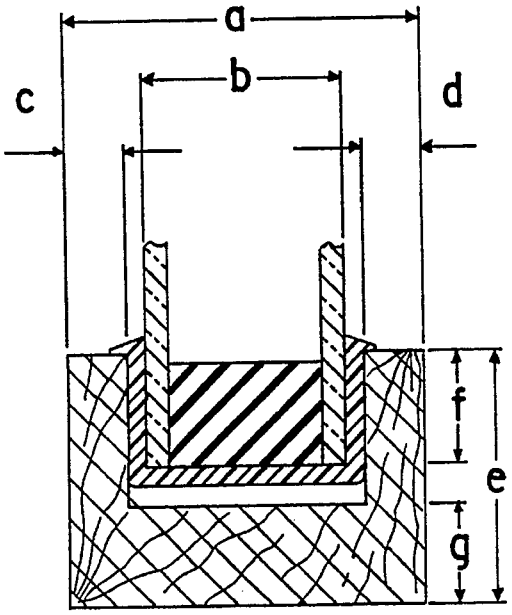
FIG. 4 PRIOR ART

In FIGS. 3 and 5–11 the plastic is vinyl. In FIGS. 5–10, the structural steel is 0.5 millimeters thick. In FIG. 11, the steel is 0.25 millimeters mesh. In FIG. 3, the vinyl is 2 millimeters thick.

As the following chart "A" shows, the present invention provides a frame member of higher strength and lower thermal transmittance at a cost that is often lower than prior art members.

CHART A

| FIGURE NO. | DESCRIPTION | DIMENSIONS IN MILLIMETERS a | b | c | d | e | f | g | h | RELATIVE STRENGTH | RE-LATIVE COST | RELATIVE THERMAL TRANSMITTANCE |
|---|---|---|---|---|---|---|---|---|---|---|---|---|
| 1 | ALUMINUM | 26.5 | 20.0 | 1.25 | 1.25 | 27.0 | 13.0 | 11.0 | | 100 | 20 | 100 |
| 2 | TB ALUMINUM | 26.5 | 20.0 | 1.25 | 1.25 | 27.0 | 13.0 | 11.0 | 6.0 | 96 | 49 | 68 |
| 3 | VINYL | 36.0 | 20.0 | 6.00 | 6.00 | 27.0 | 13.0 | 11.0 | | 19 | 44 | 49 |
| 4 | WOOD | 36.0 | 20.0 | 6.00 | 6.00 | 27.0 | 13.0 | 11.0 | | 98 | 100 | 46 |
| 5 | COMPOSITE | 29.0 | 20.0 | 2.50 | 2.50 | 27.0 | 13.0 | 11.0 | 6.0 | 99 | 24 | 67 |
| 6 | COMPOSITE | 29.0 | 20.0 | 2.50 | 2.50 | 27.0 | 13.0 | 11.0 | | 56 | 23 | 51 |
| 7 | COMPOSITE | 29.0 | 20.0 | 2.50 | 2.50 | 27.0 | 13.0 | 11.0 | 5.0 | 94 | 24 | 57 |
| 8 | COMPOSITE | 29.0 | 20.0 | 2.50 | 2.50 | 27.0 | 13.0 | 11.0 | | 99 | 36 | 56 |
| 9 | COMPOSITE | 29.0 | 20.0 | 2.50 | 2.50 | 27.0 | 13.0 | 11.0 | 14.0 | 81 | 23 | 52 |
| 10 | COMPOSITE | 29.0 | 20.0 | 2.50 | 2.50 | 27.0 | 13.0 | 11.0 | | 94 | 24 | 62 |
| 11 | COMPOSITE | 29.0 | 20.0 | 2.50 | 2.50 | 27.0 | 13.0 | 11.0 | | 33 | 23 | 60 |

Figure 12:
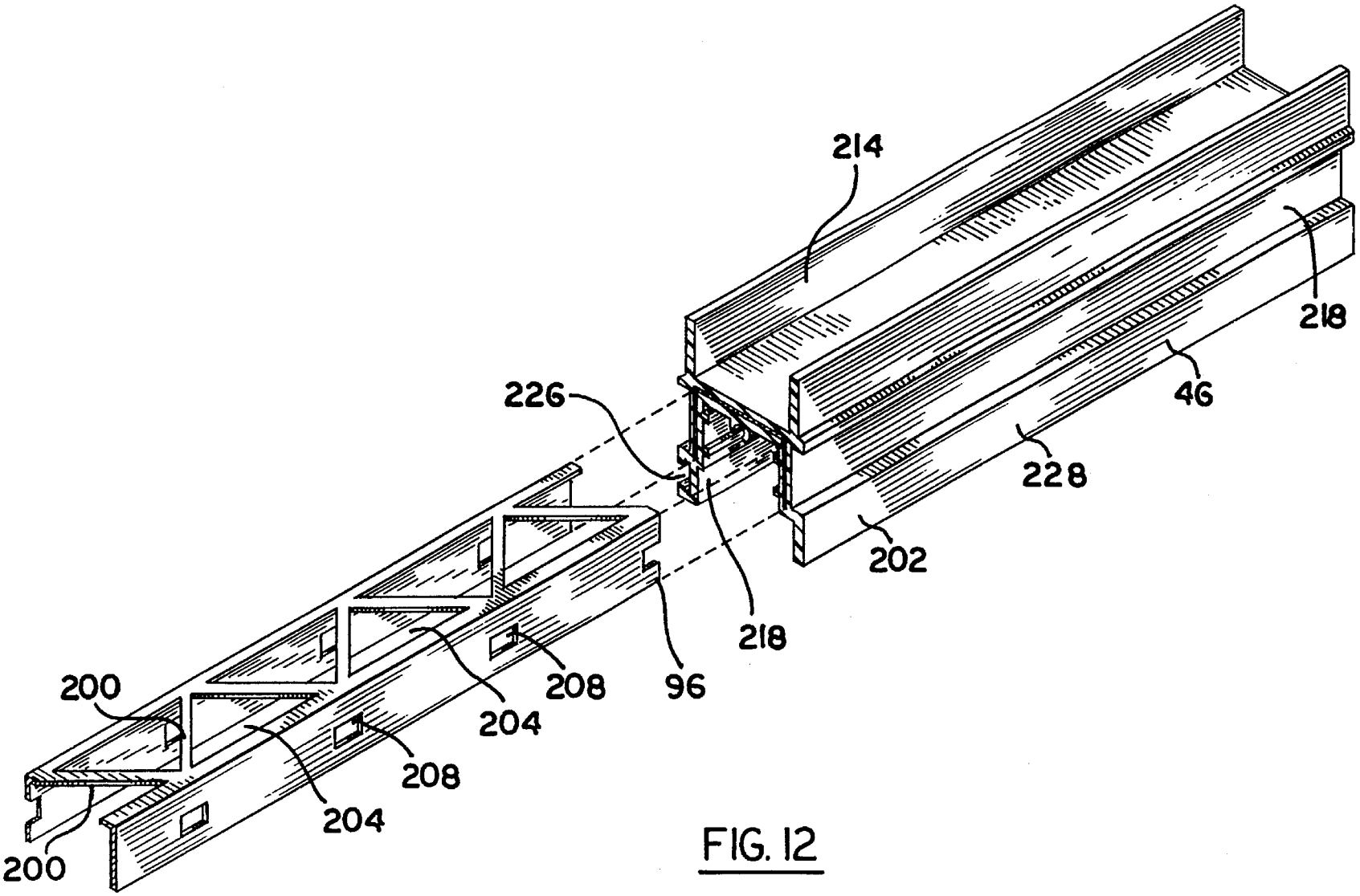
FIGS. 12–21 are further examples of constructions according to the present invention.

FIG. 12 shows frame 202 with grid 200 and openings 204 in the grid for receiving structural plastic 46 as described earlier with respect to FIG. 10. Rectangular openings 208 further contribute to the bond between the plastic and metal.

Rearwardly depending structural plastic legs 214 resist bending of frame 202. Forward channel legs 218 include specialized structural plastic extensions comprising an outward facing, longitudinal slot 226 along one extension, and a longitudinal L-shaped strip 228 along the other extension.

FIG. 13 shows a mesh, steel U-channel 114 as discussed earlier for FIG. 11, and a simple, U-shaped frame 234 with which it is extruded.

Figure 14:
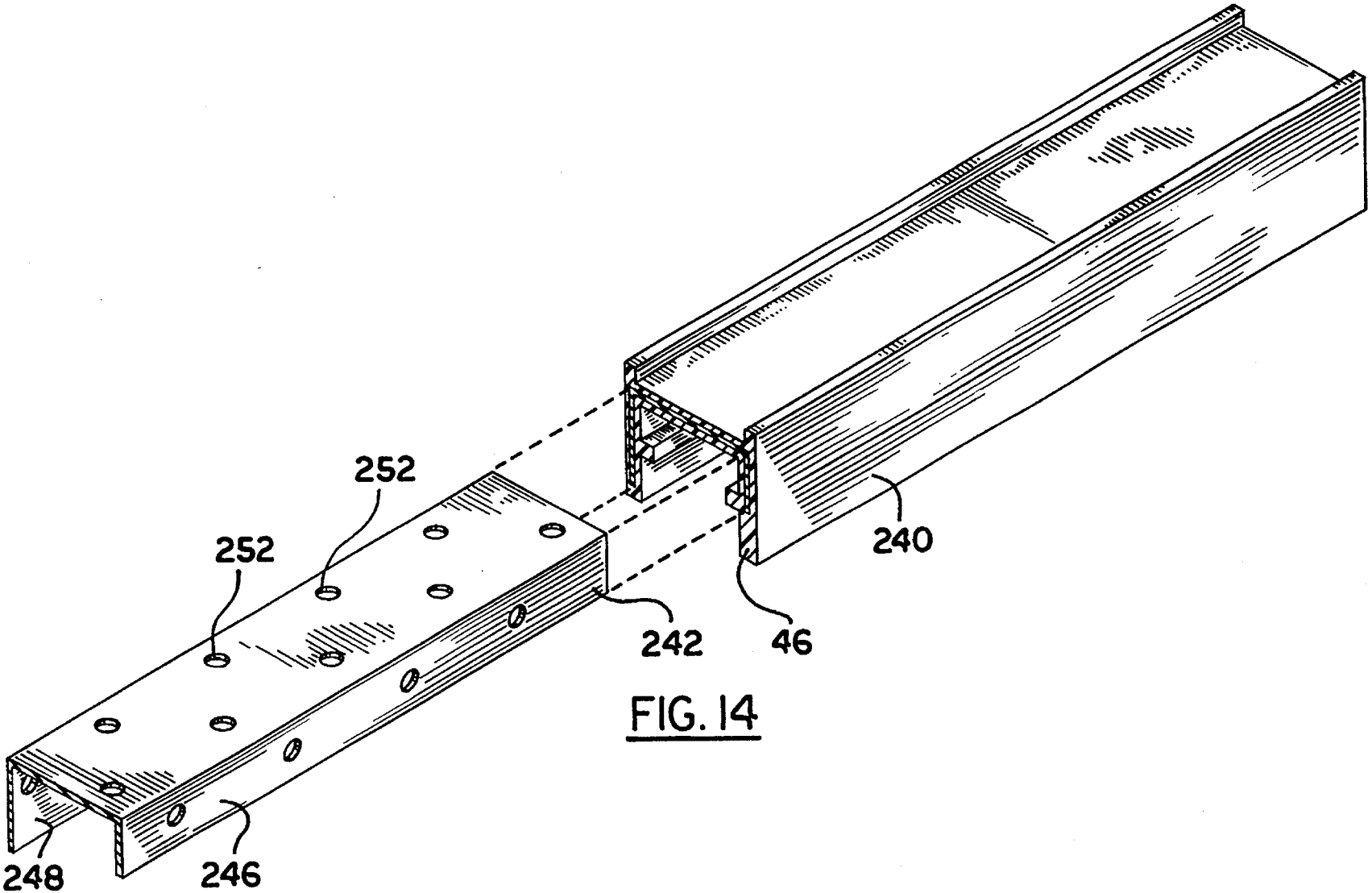

U-shaped frame 240, FIG. 14, includes J-shaped channel element 242, having leg 246 shorter than leg 248. Round openings 252 through element 242 assure a strong frame due to secure bond between structural plastic 46 and element 242.

Figure 15:
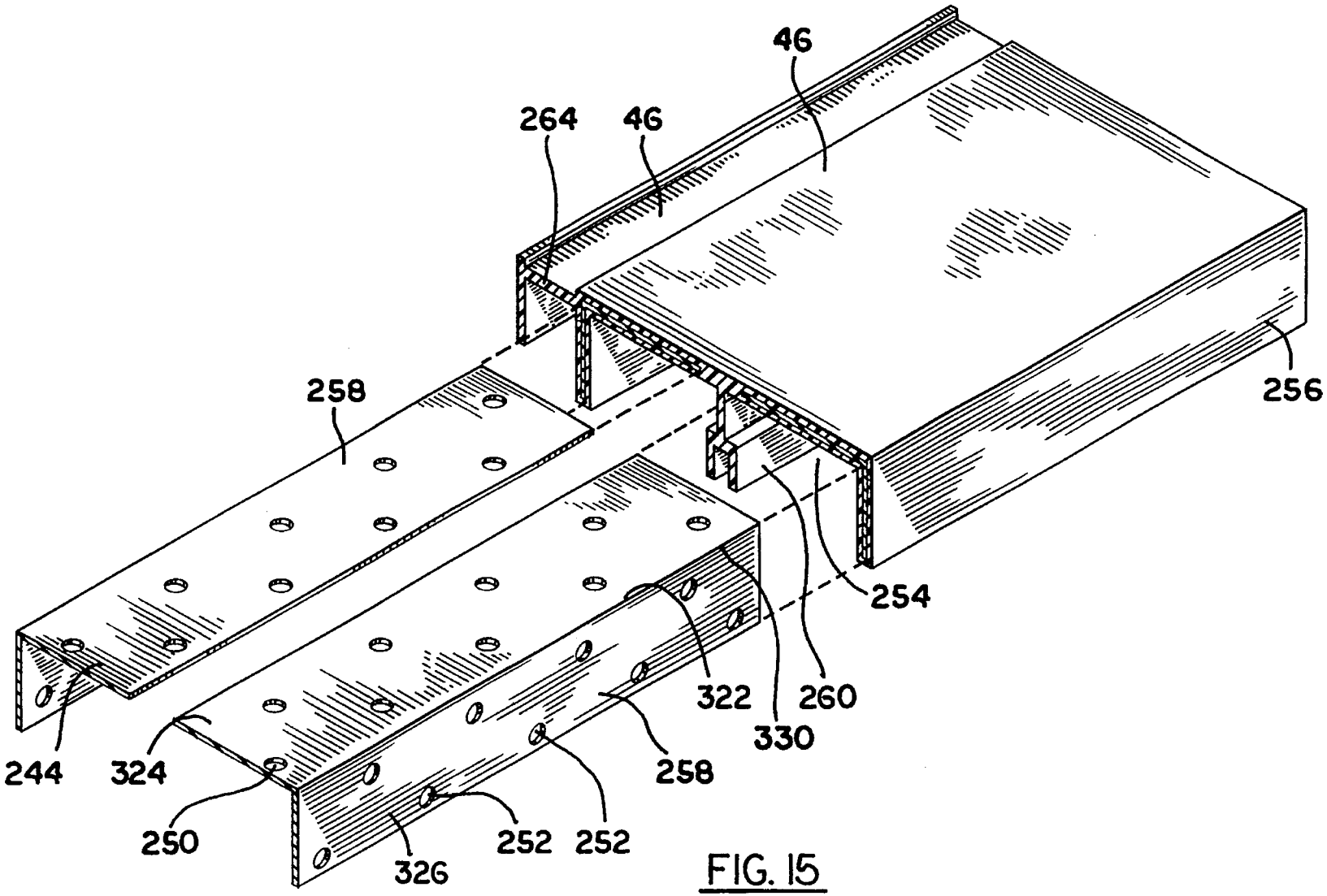

In FIG. 15, frame 256 includes channel 254 which comprises parallel L-shaped structural steel strips as described for Fig. 7, with round openings 252 for structural bond with plastic 46.

Frame 256 is molded in one continuous unitary form which includes channel 254 with plastic channel 260, plastic L strip 264, and L-shaped steel strips 258.

Figure 16:
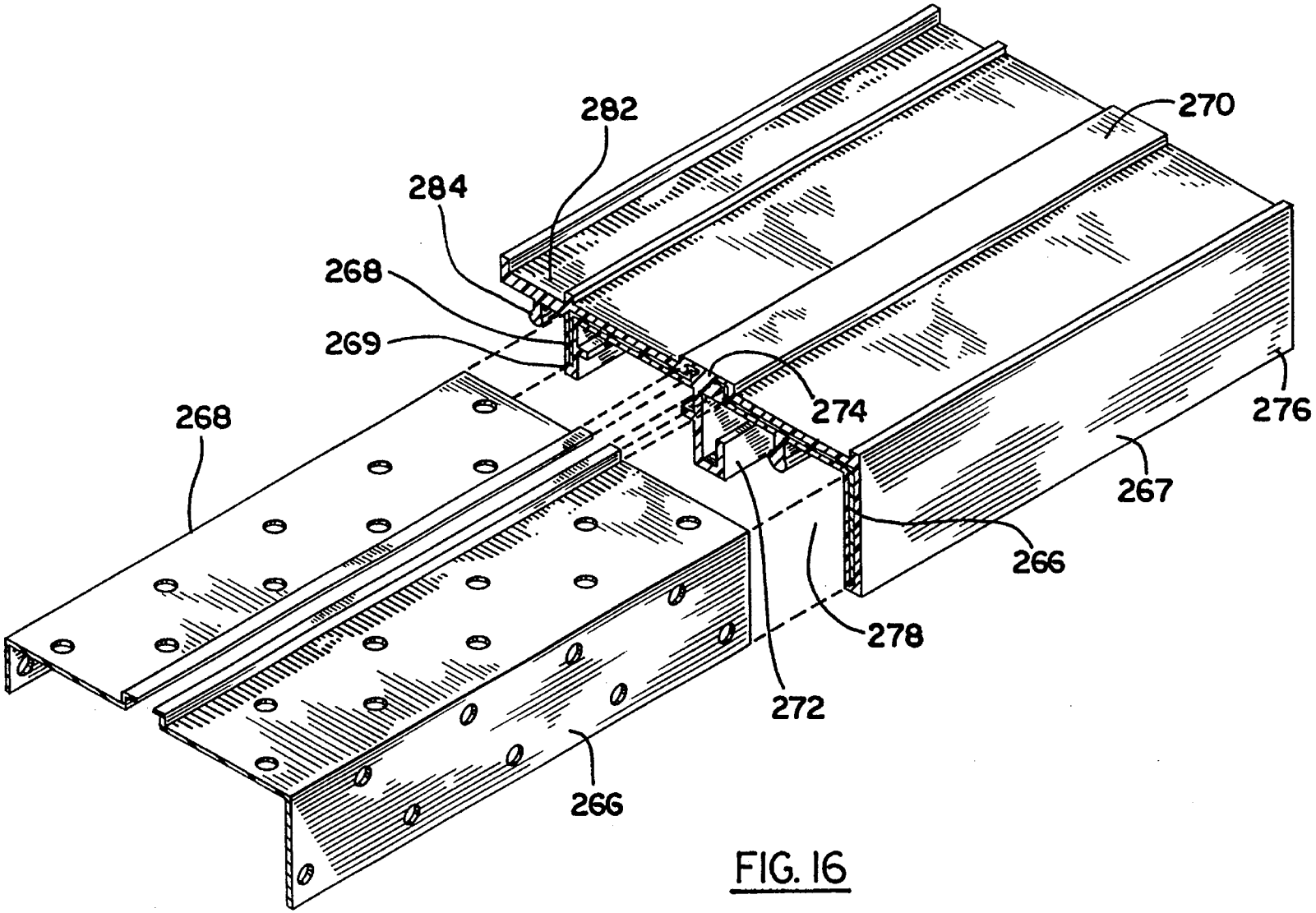

Referring to FIG. 16, the steel L strips 266 and 268 and rearwardly depending leg 270, with gap 274 of frame 276 are similar to the strip 82, leg 78, and gap 86 arrangement shown and described for frame 76 of FIG. 8. J-shaped forward leg 272 is molded within U-channel 278 about the location of gap 274. Strip 282, extending laterally from leg 269, the shorter of the two legs 267 and 269, and containing forward guide rail 284,is also integrally molded with frame 276.

Figure 17:
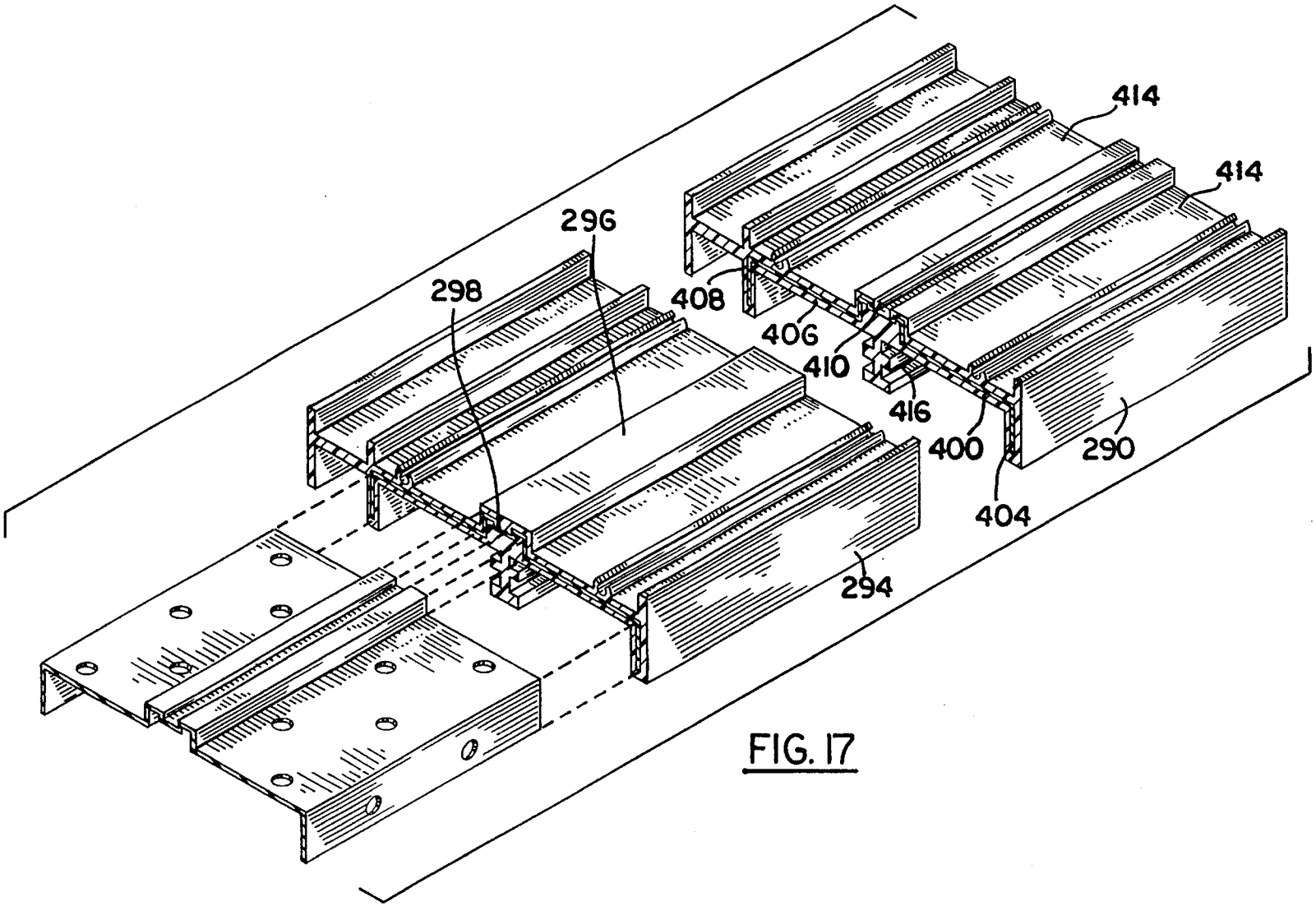

FIG. 17 shows frame 290 made from frame 294 which was extruded as a unitary item, by sawing down through rearwardly depending leg 296 just through steel U-channel element 298, similarly to the way that gap 86 was made in frame 76 shown in FIG. 8.

Figure 18:
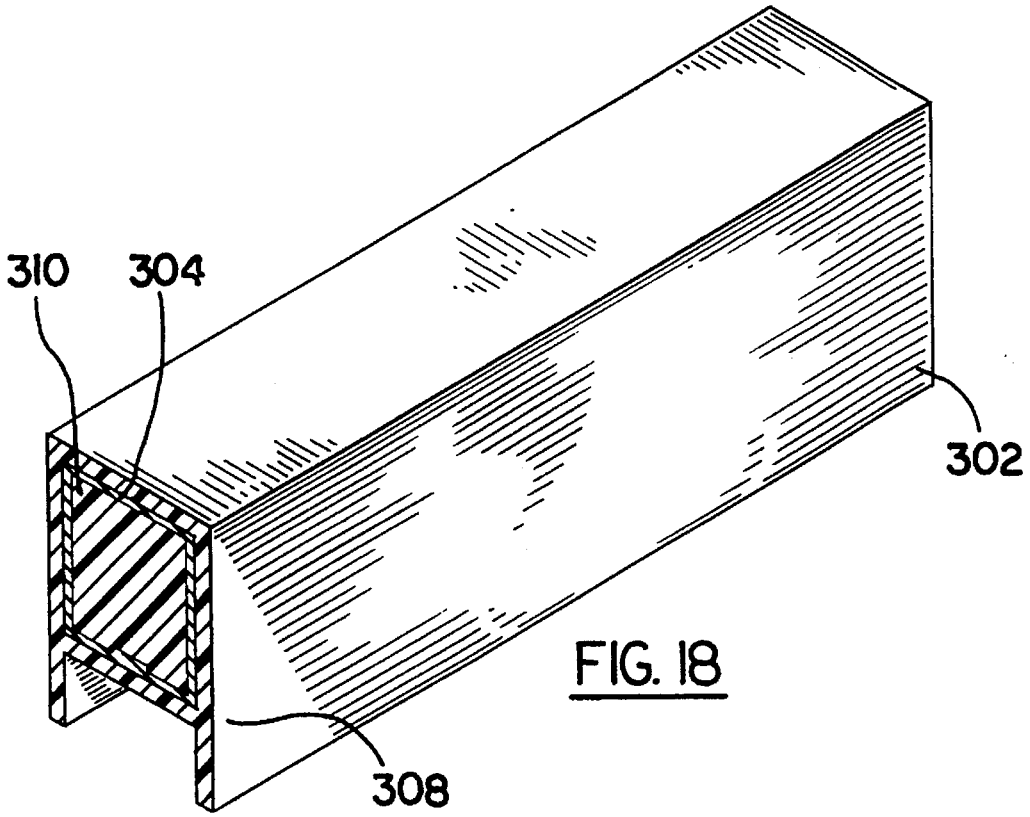

Frame 302, shown in FIG. 18, includes two structural plastics with metal box-beam 304. Plastic 308 provides stiffness and support in a required configuration, while plastic 310 and box beam 304 provide resistance to twist and bending.

Figure 19:
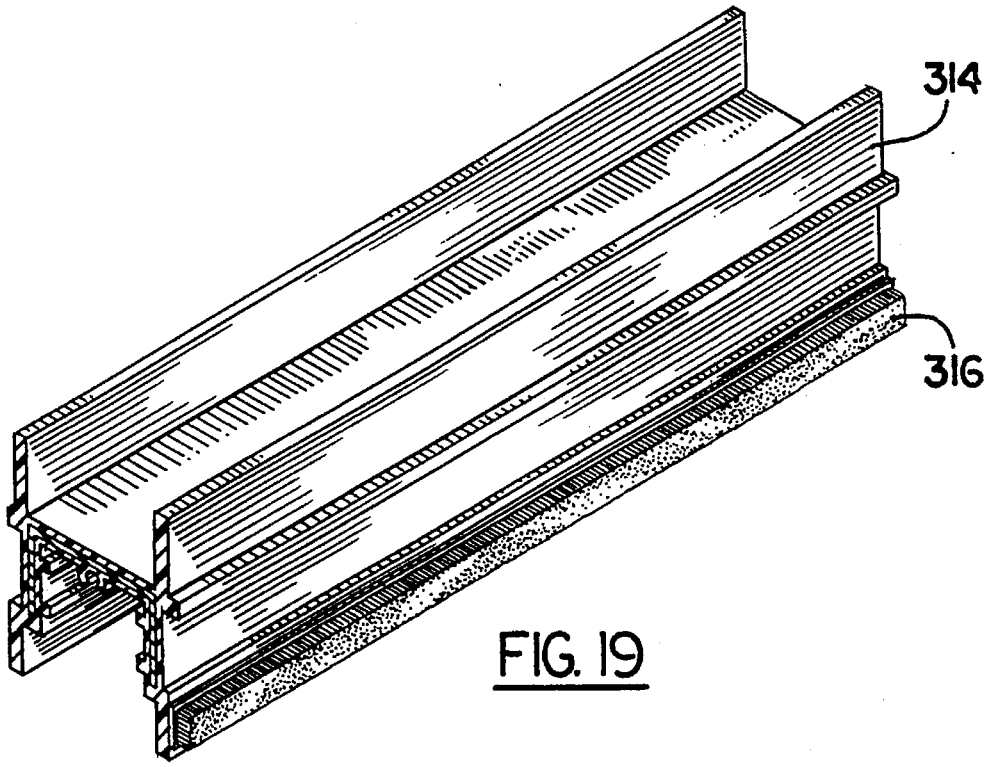

Frame 314, shown in FIG. 19 includes continuously attached weatherseal 316.

Figure 20:
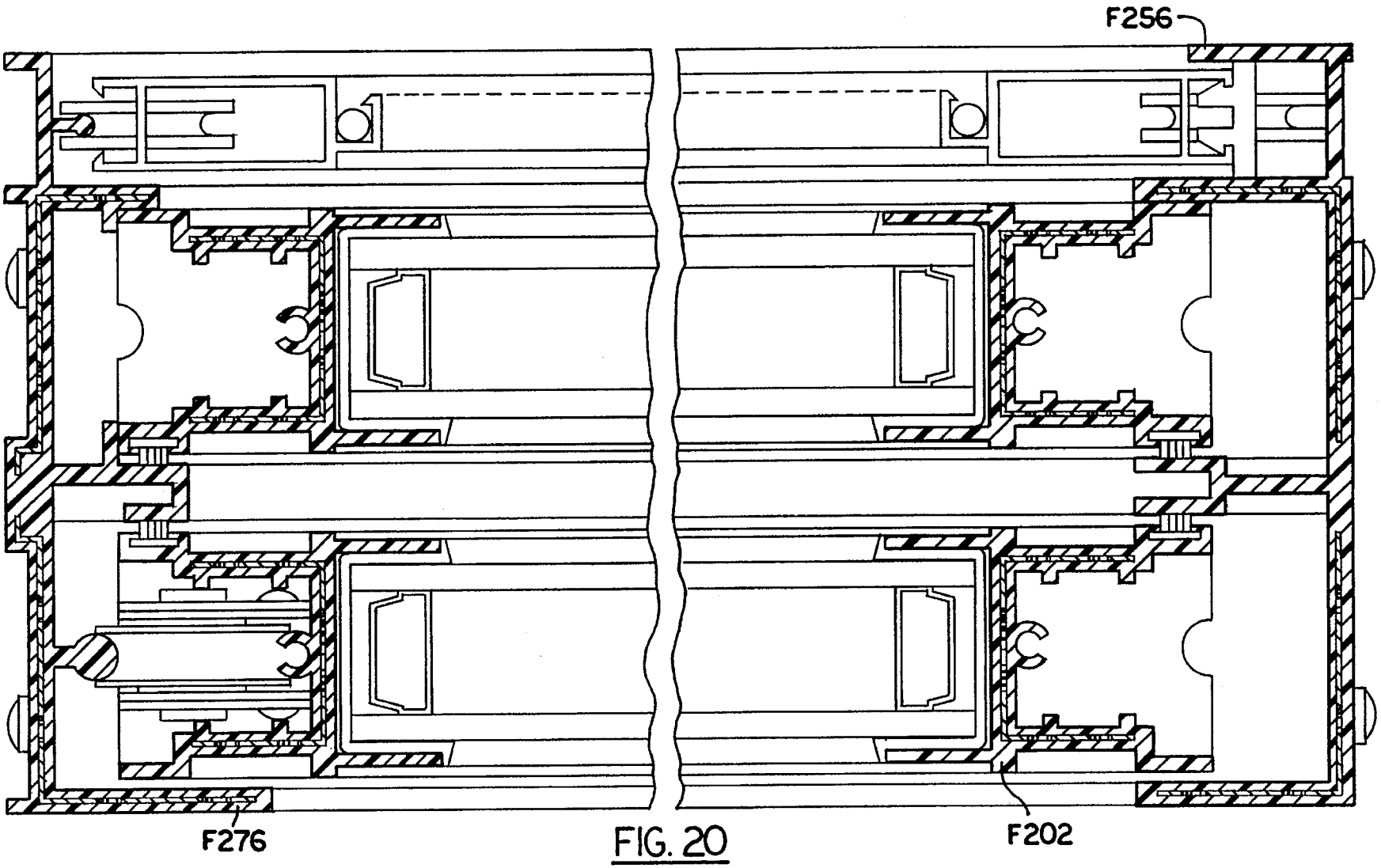
Figure 21:
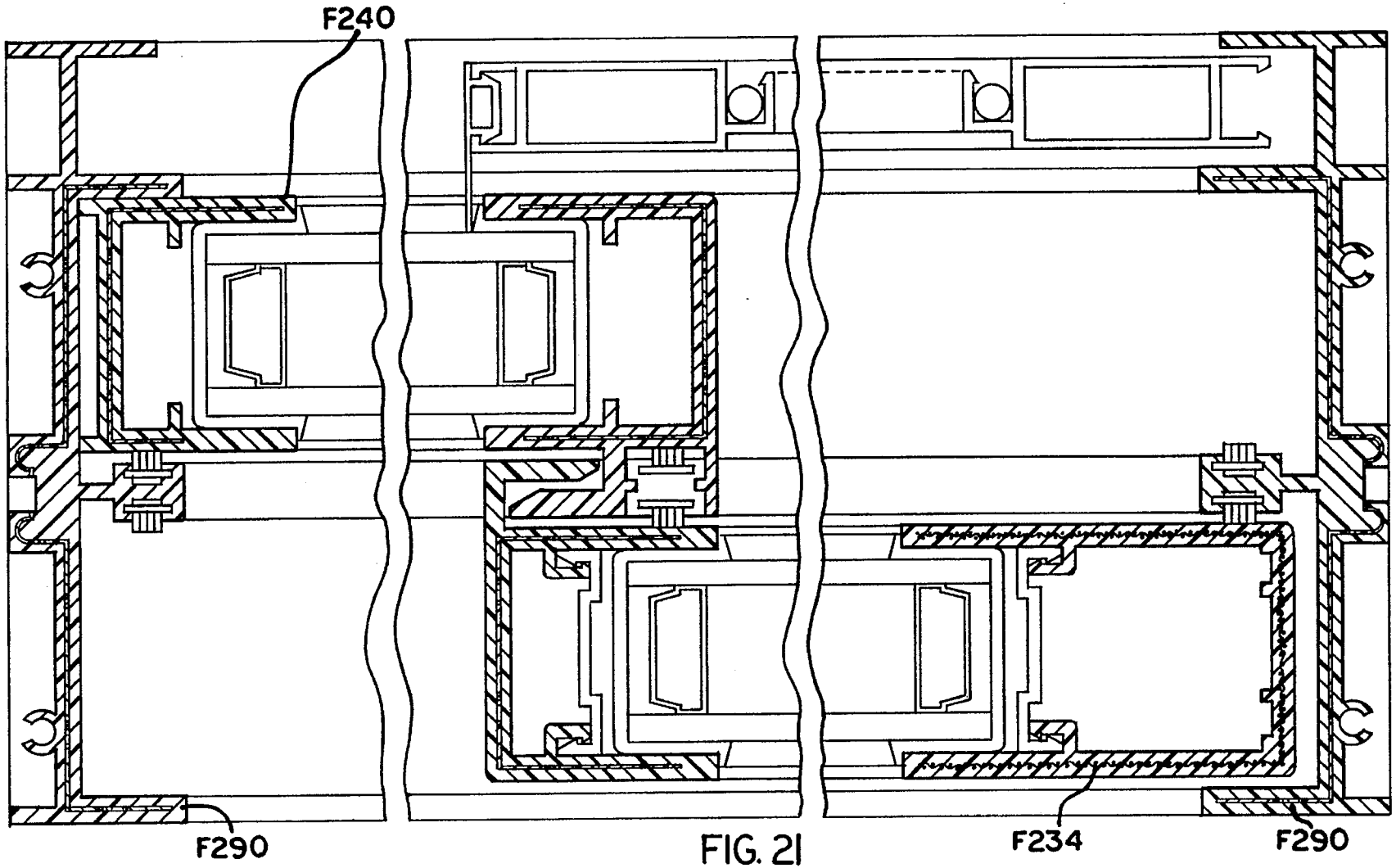

Various applications of the frames shown in FIGS. 5 through 19, and 22 through 35, may be seen in the sliding glass door assembly examples in FIGS. 20 and 21. They are designated by "F" followed by the number of a frame having similar features.

Although examples of sliding glass door framing members are shown, it should be understood that the present invention is applicable to window and other frame assemblies.

The arrangement in the ensuing descriptions of the invention provides improved lateral strength for the structural frame member, while continuing to have the combined thermal and longitudinal strength benefits of the original invention of Ser. No. 07/788,632.

Figure 22:
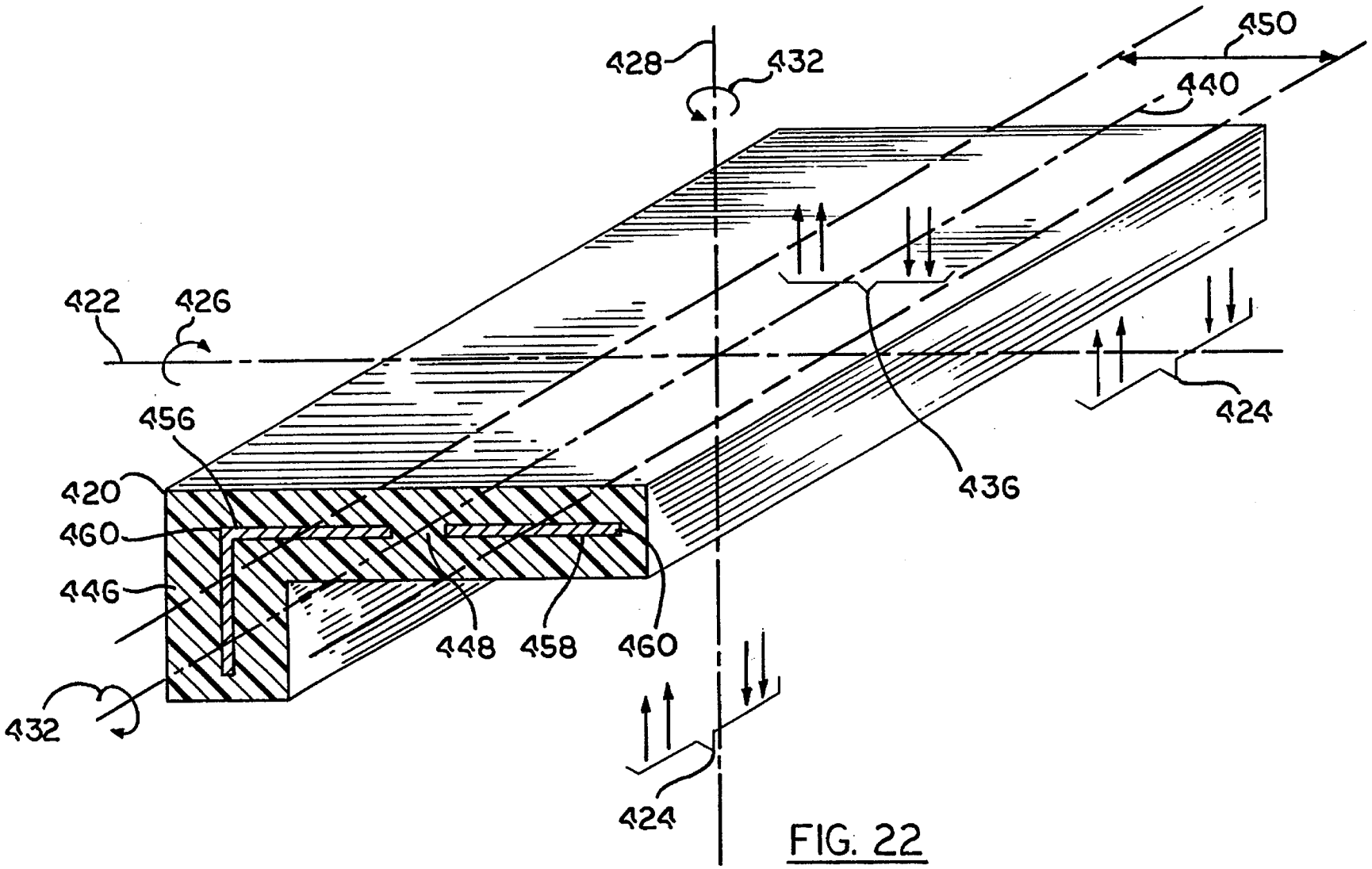
FIG. 22 is a perspective view of a structural frame member, of the invention.
Figure 23:
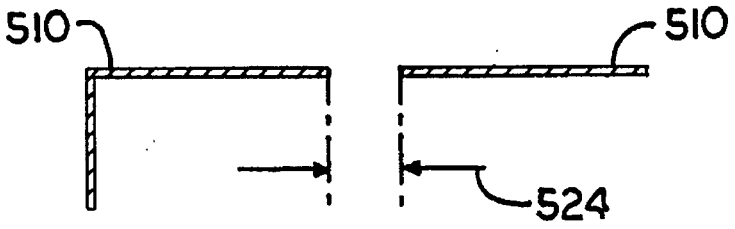
FIG. 23 is a schematic cross section end view of a discontinuous metal element for a frame member, of the invention.
Figure 24:
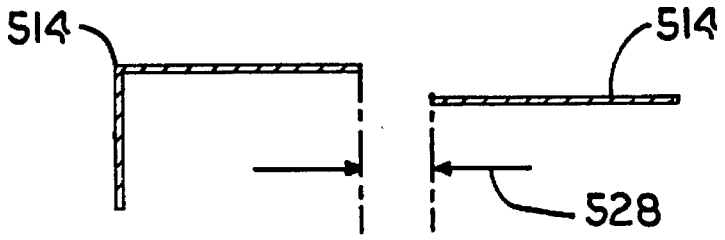
FIG. 24 is a schematic cross section end view of a discontinuous metal element for a frame member, of the invention.
Figure 25:
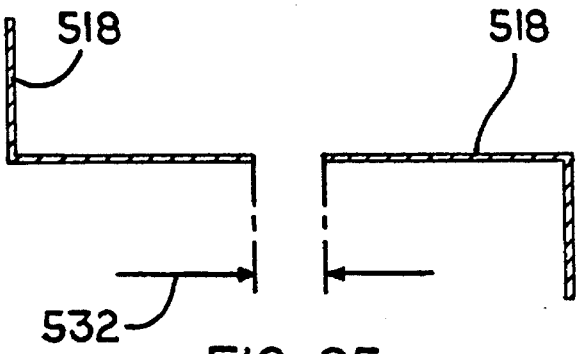
FIG. 25 is a schematic cross section end view of a discontinuous metal element for a frame member, of the invention.
Figure 26:
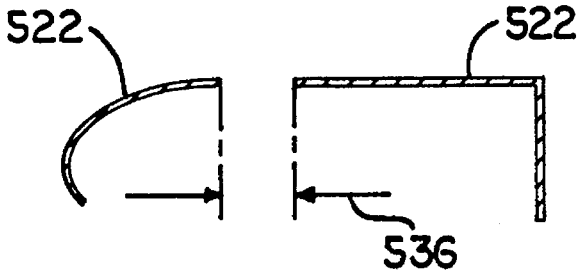
FIG. 26 is a schematic cross section end view of a discontinuous metal element for a frame member, of the invention.

In FIG. 22, frame member 420 has high longitudinal strength in resistance to shear 424, bending 426, or breaking about lines 422 and 428.

Lateral strength in resistance to shear 440, bending 432, or breaking is not as great, however, about line 440. Line 440 extends the length of gap 448 between generally parallel 450 walls 456 and 458 of metal element 460 in plastic element 446.

In FIGS. 23–26, discontinuous metal elements 510, 514, 518, and 522 also do not have the high resistance to shear, bending, or breaking across the longitudinal discontinuity in the metal elements of gaps 524, 528, 532, and 536 which extend essentially the lengths of the elements respectively. This can result in bending, cracking or breaking of the structural frame member comprising the metal elements.

Figure 27:
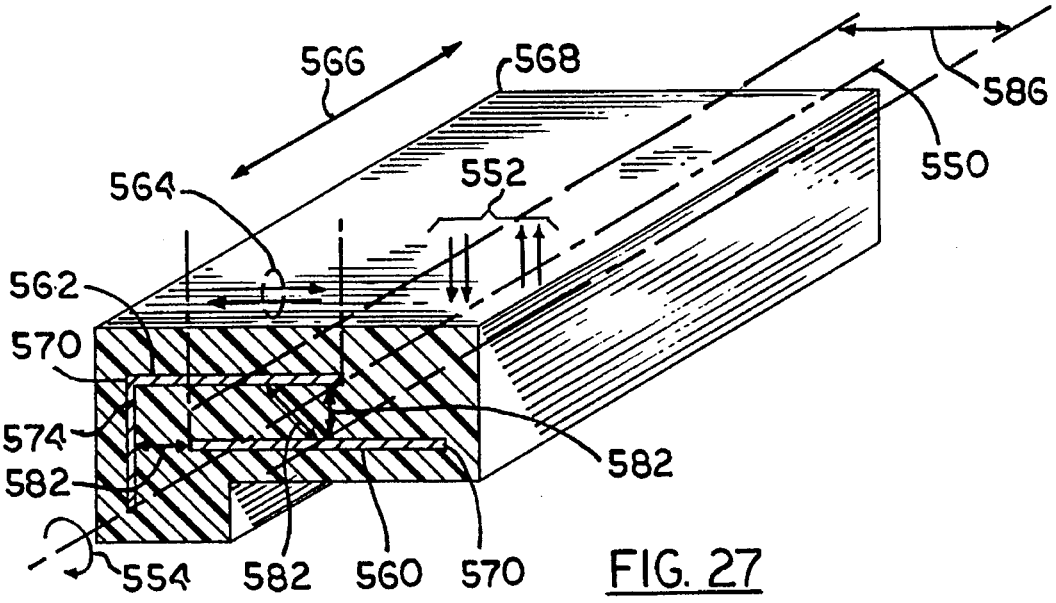
FIG. 27 is a perspective view of a structural frame member, of the invention.

In FIG. 27, resistance to shear 552, bending 554 or breaking about line 550 is prevented by wall 560 and wall 562 intersecting laterally 564 to length direction 566 of frame member 568. In addition the arrangement has the discontinuity in metal element 570 in that wall 560 is separate from and continuously spaced from walls 562 and 574 along the length of the frame member. Also, in FIG. 27, metal element 570 is discontinuous normal 582 to length direction 566 of frame member 568 and metal element 570. Also, wall 560 is generally parallel with the joined walls 570 and 574, as parallel strips 586.

Figure 28:
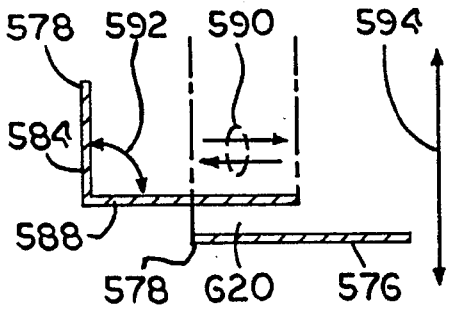
FIG. 28 is a schematic cross section end view of a discontinuous metal nt for a frame member, of the invention.

In FIG. 28, in discontinuous metal element 578 the intersection laterally 590 to length direction 594 of walls 576 and 588 in the continuous space 620 between the walls that extends longitudinally with the walls, provides lateral strength. Wall 576 is separate from walls 588 and 584. Wall 584 is angled 592 from the plane of wall 588.

Figure 29:
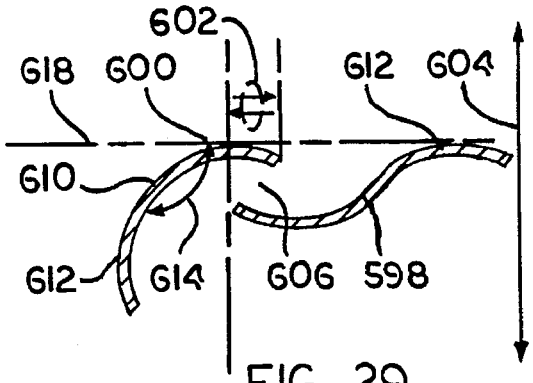
FIG. 29 is a schematic cross section end view of a discontinuous metal element for a frame member, of the invention.

In FIG. 29, the intersection laterally 602 to length direction 604, of walls 598 and 600 in the space 606 that extends continuously the length of metal element 612 between wall 598 and walls 600 and 610, provides lateral strength. Wall 610 is continuously joined with wall 600 along the length of metal element 612, and is angled 614 from tangent line 618 of wall 600. Wall 598 is separate from walls 610 and 600.

Figure 30:
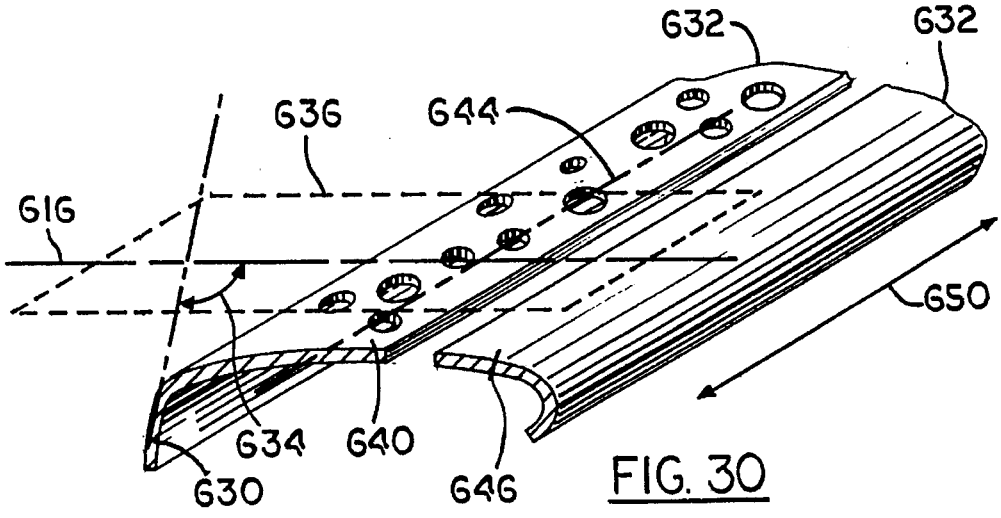
FIG. 30 is a perspective view of a structural frame member, of the invention.

In FIG. 30, wall 630 of metal element 632 is continuously joined with wall 640 along the length of metal element 632, and angled 634 from plane 636 which is tangent to curved wall 640 along line 644.

Metal element 632 does not provide the additional lateral strength benefits discussed above. Wall 646 does not intersect laterally to length direction 650 with joined walls 630 and 640.

Figure 31:
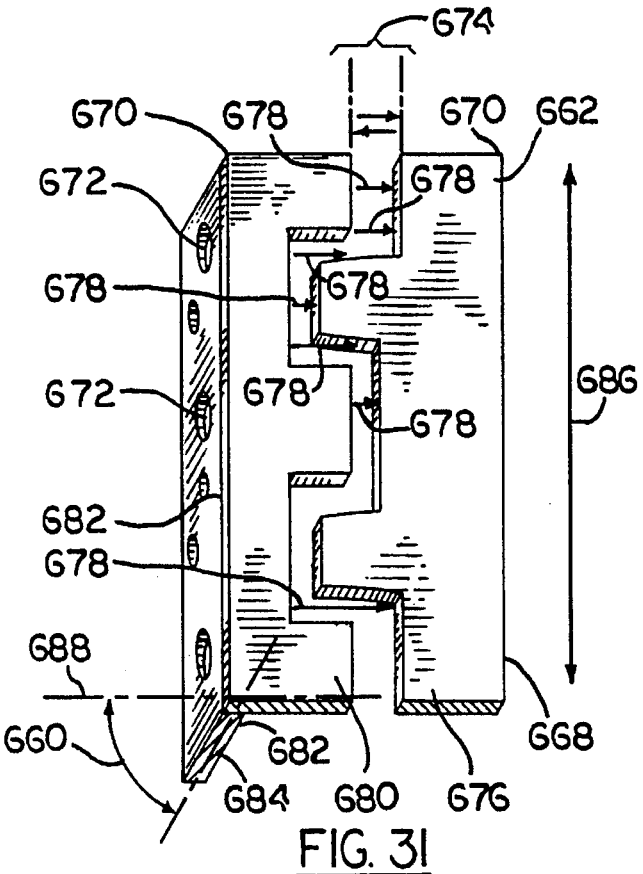
FIG. 31 is a perspective view of a discontinuous metal element for a structural frame member of the invention.

In FIG. 31, metal element 670 has wall 676 intersecting wall 680 of joined walls 680 and 684, laterally 674 to length direction 686. This provides the improved lateral strength.

Metal element 670 is discontinuous normal to the length as shown by arrows 678. Wall 680 is connected to side 682 of wall 684 in a continuous joining along the length of the first wall, and angled 660 from tangent 688 to wall 680. Wall 676 is separate from walls 680 and 684. Side 668 of wall 676 is parallel with side 682 of wall 684 substantially along the length of wall 684. Side 662 is also parallel with side 682 substantially along the length of wall 684. Wall 676 and wall 680 extend along length 686 like parallel strips, as do walls 676 and 684. Wall 684 includes a plurality of openings 672 through the wall, enclosed within the wall and exclusive of the adjacent wall, for receiving plastic through the openings.

Figure 32:
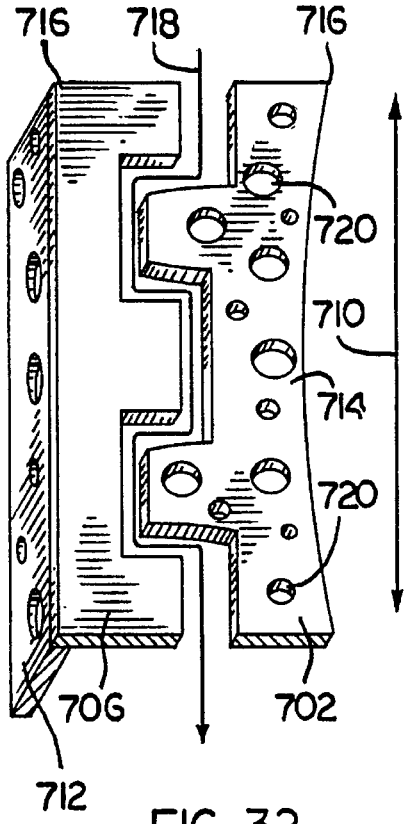
FIG. 32 is a perspective view of a discontinuous metal element for a structural frame member of the invention.

Referring to FIG. 32, wall 702 is continuously spaced from wall 706 along the length 710 of metal element 716, as shown by arrow 718 which travels through the space. Walls 702 and 706 are generally parallel along length 710, as parallel strips. Wall 702 is also generally parallel with joined walls 706 and 712, as parallel strips. Side 714 of wall 702 is slightly curved inward so that the structural frame member which comprises metal element 716 fits with a slightly bowed associate part of a window frame (not shown). Wall 702 includes a plurality of openings 720 through the wall, enclosed with the wall and exclusive of the adjacent wall, and of other walls in metal element 716, for receiving plastic through the openings.

Figure 33:
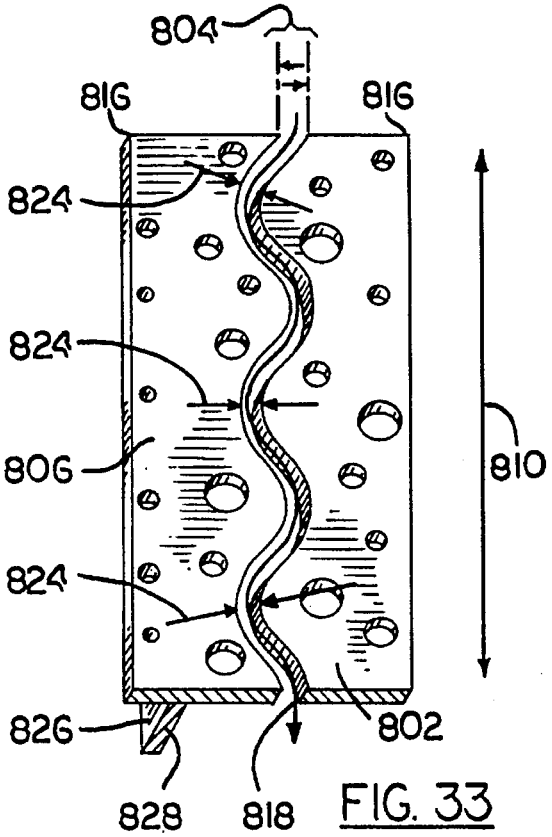
FIG. 33 is a perspective view of a discontinuous metal element for a structural frame member of the invention.

In FIG. 33, the lateral intersection 804 of walls 802 and 806 has continuous 818, parallel spacing 824 between walls 802 and 806 along the length 810 of metal element 816 which is discontinuous by way of the continuous spacing along the length of the metal element. Wall 828 is connected on side 826 to wall 806 in a continuous joining along the length 810 of wall 806.

Figure 34:
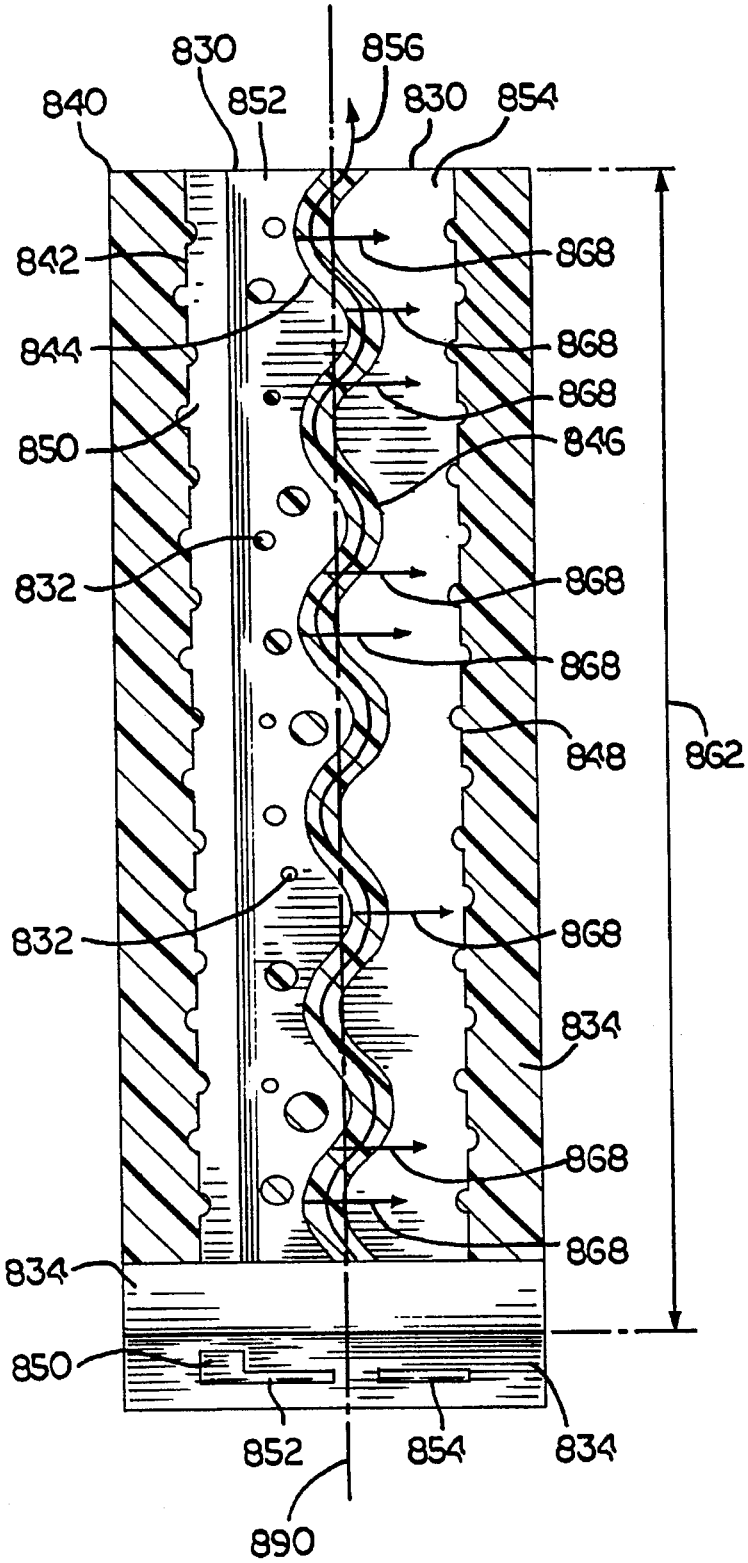
FIG. 34 is a perspective view taken from V34, of the structural frame member of FIG. 35 in which the plastic element is partially cut away to reveal the metal element.
Figure 35:
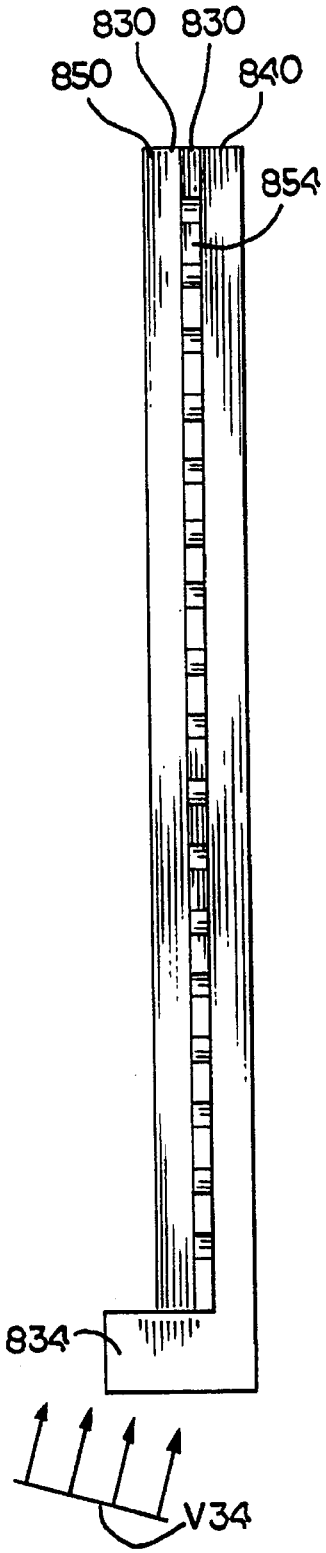
FIG. 35 is a side view of a structural frame member, with the plastic partially cut away.

Referring to FIGS. 34 and 35, structural frame member 840 provides a maximum of longitudinal and lateral strength.

Maximum grip between discontinuous metal element 830 and plastic element 834 of structural frame member 840 is provided by serpentine edges 842, 844, 846 and 848 of continuously spaced, generally parallel walls 852 and 854, and wall 850, wherein the serpentine edges supplement the grip provided by openings 832, and plastic element 834 encloses metal element 830 on essentially on all surfaces along its length in a composite, unitary molding with metal element 830.

Good resistance to shear, bending or breaking about line 890 is provided by the crossing over of line 890 by walls 852 and 854 as they intersect laterally to the length of metal element 830.

Lateral thermal flow is minimized by continuous space 856 between separate walls 852 and 854 of discontinuous metal element 830, which is discontinuous normal to length 862 of metal element 830, as shown by arrows 868.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. In an improved inflexible substantially straight, structural frame member of predetermined shape, for windows, doors or the like assemblies, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially alone the length of said first wall, and angled from said first wall, a first plurality of openings through said first wall, enclosed within said first wall, and exclusive of said second wall, said second element being molded to itself from the front to the back of said first wall through said first plurality of openings, the improvement comprising said first element further being discontinuous in that it comprises a third wall being essentially separate from said first and second walls, and being generally parallel with said first and second walls substantially along the length of said first wall, as parallel strips.

2. The frame member of claim 1, further comprising:

said third wall and one of said first and second walls intersecting laterally.

3. The frame member of claim 1, further comprising:

said third wall being continuously spaced from said first and said second walls essentially the length of said first element.

4. The frame member of claim 3, further comprising:

said third wall and one of said first and second walls intersecting laterally.

5. The frame member of claim 1, further comprising:

the angle of said second wall from said first wall being from a plane of said first wall, said third wall and one of said first and second walls intersecting laterally.

6. The frame member of claim 1 further comprising:

the angle of said second wall from said first wall being from a tangent of said first wall, said third wall and one of said first and second walls intersecting laterally.

7. In an improved inflexible substantially straight, structural frame member of predetermined shape, for windows, doors or the like assemblies, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially along the length of said first wall, and angled from said first wall, a first plurality of openings through said first wall, enclosed within said first wall, and exclusive of said second wall, said second element being molded to itself from the front to the back of said first wall through said first plurality of openings, the improvement comprising said first element further being discontinuous normal to the length in that it comprises a third wall being essentially separate from said first and second walls, and being generally parallel with said first and second walls substantially along the length of said first wall, as parallel strips.

8. The frame member of claim 7, further comprising:

said third wall and one of said first and second walls intersecting laterally.

9. The frame member of claim 8, further comprising:

said third wall being continuously spaced from said first and said second walls essentially the length of said first element.

10. In an improved inflexible substantially straight, structural frame member of predetermined shape, for windows, doors or the like assemblies, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially along the length of said first wall, and angled from said first wall, a first plurality of openings through and enclosed within a wall of said first element, and exclusive of adjacent walls of said first element, said second element being molded to itself from the front to the back of the wall containing said first plurality of openings, through said first plurality of openings, the improvement comprising said first element further being discontinuous in that it comprises a third wall being essentially separate from said first and second walls, and being generally parallel with said first and second walls substantially along the length of said first wall, as parallel strips.

11. The frame member of claim 10 further comprising:

said third wall and one of said first and second walls intersecting laterally.

12. In an improved inflexible substantially straight, structural frame member of predetermined shape, for windows, doors or the like assemblies, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially along the length of said first wall, and angled from said first wall, a first plurality of openings through and enclosed within a wall of said first element, and exclusive of adjacent walls of said first element, said second element being molded to itself from the front to the back of the wall containing said first plurality of openings, through said first plurality of openings, the improvement comprising said first element further being discontinuous normal to the length in that it comprises a third wall being essentially separate from said first and second walls, and being generally parallel with said first and second walls substantially along the length of said first wall, as parallel strips.

13. The frame of claim 12, further comprising:

said third wall and one of said first and second walls intersecting laterally.

* * * * *